US010003117B2

(12) United States Patent
Natsuhara et al.

(10) Patent No.: US 10,003,117 B2
(45) Date of Patent: Jun. 19, 2018

(54) TWO-PORT TRIPLATE-LINE/WAVEGUIDE CONVERTER HAVING TWO PROBES WITH TIPS EXTENDING IN DIFFERENT DIRECTIONS

(71) Applicant: Japan Radio Co., Ltd., Tokyo (JP)

(72) Inventors: Keiichi Natsuhara, Tokyo (JP); Yusuke Kato, Tokyo (JP); Katsuyoshi Ishida, Tokyo (JP); Kiyomi Okawa, Tokyo (JP); Takeshi Oga, Tokyo (JP); Yuzo Shibuya, Tokyo (JP); Kazufumi Igarashi, Tokyo (JP)

(73) Assignee: JAPAN RADIO CO., LTD., Tokyo (JP)

( * ) Notice: Subject to any disclaimer, the term of this patent is extended or adjusted under 35 U.S.C. 154(b) by 0 days. days.

(21) Appl. No.: 14/898,733

(22) PCT Filed: May 23, 2014

(86) PCT No.: PCT/JP2014/063684
§ 371 (c)(1),
(2) Date: Dec. 15, 2015

(87) PCT Pub. No.: WO2014/203682
PCT Pub. Date: Dec. 24, 2014

(65) Prior Publication Data

US 2016/0141740 A1 May 19, 2016

(30) Foreign Application Priority Data

Jun. 18, 2013 (JP) ..... 2013-127069

(51) Int. Cl.
*H01P 5/107* (2006.01)
*H01P 5/12* (2006.01)
(Continued)

(52) U.S. Cl.
CPC ..... *H01P 5/107* (2013.01); *H01P 3/12* (2013.01); *H01P 5/12* (2013.01); *H01Q 9/42* (2013.01); *H01Q 21/061* (2013.01)

(58) Field of Classification Search
CPC ..... H01P 5/107; H01P 5/12; H01Q 21/0037; H01Q 21/065
(Continued)

(56) References Cited

U.S. PATENT DOCUMENTS 5,258,727 A 11/1993 DuPuis et al.
5,394,119 A 2/1995 Pleva et al.
(Continued)

FOREIGN PATENT DOCUMENTS

CL 199600974 3/1997
CL 199900308 11/1999
(Continued)

OTHER PUBLICATIONS

PCT/JP2014/063684 International Application No., International Search Report dated Jul. 29, 2014.
(Continued)

*Primary Examiner* — Benny Lee
(74) *Attorney, Agent, or Firm* — Nixon Peabody LLP; Jeffrey L. Costellia

(57) ABSTRACT

A two-port triplate-line/waveguide converter in one embodiment of this invention is provided with a rectangular waveguide and two probes that connect to central conductors of separate trip late lines via slits, said slits being formed separately on two opposing inside walls of the rectangular waveguide and lying on an imaginary straight line that is perpendicular to said inside walls. The two probes, the tips of which are bent inside the rectangular waveguide, constitute monopole antennas with the aforementioned inside walls functioning as the ground planes thereof.

3 Claims, 10 Drawing Sheets

(51) Int. Cl.
*H01Q 9/42* (2006.01)
*H01P 3/12* (2006.01)
*H01Q 21/06* (2006.01)

(58) Field of Classification Search
USPC ..... 333/26, 125, 137
See application file for complete search history.

(56) References Cited

U.S. PATENT DOCUMENTS

| | | | | |
|---|---|---|---|---|
| 5,539,361 | A | 7/1996 | Davidovitz | |
| 6,967,543 | B2 * | 11/2005 | Ammar | H01P 5/103 333/125 |
| 2009/0309804 | A1 | 12/2009 | Chen et al. | |
| 2010/0117756 | A1 | 5/2010 | Huang et al. | |
| 2010/0225410 | A1 | 9/2010 | Margomenos et al. | |
| 2011/0109409 | A1 | 5/2011 | Lan et al. | |
| 2014/0022742 | A1 * | 1/2014 | Shen et al. | H05K 1/18 361/748 |
| 2014/0176253 | A1 * | 6/2014 | Niman et al. | H01P 5/107 333/26 |

FOREIGN PATENT DOCUMENTS

| | | | |
|---|---|---|---|
| CL | 199900329 | | 9/2000 |
| CL | 201503613 | | 12/2015 |
| JP | 02-171006 | A | 7/1990 |
| JP | 05-48326 | | 2/1993 |
| JP | 05-160609 | | 6/1993 |
| JP | 07-52803 | | 6/1995 |
| JP | 08-293706 | | 11/1996 |
| JP | 2595339 | B | 4/1997 |
| JP | 09-312515 | A | 12/1997 |
| JP | 11-312909 | A | 11/1999 |
| JP | 2005-012362 | | 1/2005 |
| JP | 2005-094314 | | 4/2005 |
| JP | 2011-199499 | | 10/2011 |
| JP | 2011-223050 | A | 11/2011 |
| JP | 2012-175181 | A | 9/2012 |
| JP | 2012-526429 | A | 10/2012 |
| WO | 03-092115 | A1 | 11/2003 |
| WO | 2010/127709 | A1 | 11/2010 |
| WO | 2013-017846 | A1 | 2/2013 |

OTHER PUBLICATIONS

European Search Report to EP Application No. 14 81 3011 dated Jan. 19, 2017.
Chilean Office Action dated Oct. 24, 2017 issued in a Chilean Application No. 2015-003622.
Japanese Notice of Allowance (Application No. 2013-127069) dated Mar. 6, 2018.

* cited by examiner

TWO-PORT TRIPLATE-LINE/WAVEGUIDE CONVERTER HAVING TWO PROBES WITH TIPS EXTENDING IN DIFFERENT DIRECTIONS

CROSS-REFERENCE TO RELATED PATENT APPLICATION

The present application is a National Stage Application of International Application No. PCT/JP2014/063684 entitled "TWO-PORT TRIPLATE-LINE/WAVEGUIDE CONVERTER" filed May 23, 2014, which claims priority to Japanese Patent Application Number 2013-127069 filed Jun 18, 2013, the contents of which are incorporated herein by reference in their entirety.

TECHNICAL FIELD

The present invention relates to a two-port triplate-line/waveguide converter which has two ports coupled to an electromagnetic field in a rectangular waveguide and transfers the electromagnetic field to triplate lines connected to these ports.

BACKGROUND ART

Satellite communication and fixed wireless access systems (FWA) in which wireless transmission is performed in a microwave band of 10 GHz or above or in a millimeter wave band mostly employ planar antennas consisting of an array of a large number of patch antennas. A feed line for these patch antennas has a simple structure, so that a parallel feed can be precisely realized at low cost. Moreover, the feed line is formed as a triplate line capable of ensuring high gain and high efficiency.

As shown in FIG. 6, a conventional triplate feed type planar antenna includes, for example, a ground plane 41, a foam sheet 42-1, a flexible substrate 43, a foam sheet 42-2, and a slot plate 44.

The elements stacked in this way are configured as follows.

(1) On an upper surface of the ground plane 41, a pattern corresponding to the ground is formed.

(2) The foam sheets 42-1 and 42-2 are configured as a cushion material, a heat insulating material, and a dielectric with the flexible substrate 43 interposed between both surfaces thereof.

(3) On the flexible substrate 43, an array of rectangular patch antennas 43$A_{1,1}$ to 43$A_{m,n}$(m and n are integers) arranged in a grid shape and a feed line 43F which realizes a feed for these patch antennas are formed as a circuit pattern.

(4) Slot openings 44$S_{1,1}$ to 44$S_{m,n}$ in a grid shape are formed at positions individually corresponding to the patch antennas in a top surface of the slot plate 44, and a ground pattern is formed all over the surface other than these positions.

A feed system of such a triplate feed type planar antenna is configured, for example, as shown in FIG. 7, as follows.

A waveguide-triplate line converter (simply referred to as "converter" below) 43C is disposed at a predetermined position surrounded by the patch antennas 43$A_{1,1}$ to 43$A_{m,n}$ on the flexible substrate 43.

Also, on the flexible substrate 43 (FIG. 6), a main line 43B is formed to have one end extending to a probe 43CP inserted from a sidewall of a waveguide 43$C_{wc}$ constituting the converter 43C into the waveguide 43$C_{wc}$ and the other end extending to a bus bar 43FM of the aforementioned feed line 43F realizing the feed.

Among the components of the converter 43C, the waveguide 43$C_{wc}$ (FIG. 7) includes the following elements, as shown in FIG. 8.

(1) A waveguide flange 43CF that corresponds to (i.e. is connected to) one end of a rectangular waveguide connected to a wireless device not shown in the drawings, has a rectangular opening extending into the rectangular waveguide, and is disposed with the opening in contact with the corresponding position of the ground plane 41;

(2) An annular member 43CR that is formed in the stacked foam sheet 42-1, flexible substrate 43, and foam sheet 42-2, inserted into a through-hole corresponding to an imaginary extended portion of the opening, and formed as a conductive cylinder having a through-hole penetrated by the aforementioned probe 43CP (FIG. 7);

(3) An annular member 43Cr that is stacked on the annular member 43CR with the slot plate 44 interposed therebetween, and extends from the inside of the waveguide flange 43CF to the outside of the slot plate 44 together with the annular member 43CR;

(4) A short plate 43Cs that is laid on a top portion of the annular member 43Cr including an opening, and has a top portion in which holes (not shown) penetrated by screws 43 S-1 to 43S-5 to be described below are formed; and (5) The screws 43S-1 to 43S-5 that sandwich the ground plane 41, the annular member 43CR, the slot plate 44, and the annular member 43Cr between the waveguide flange 43CF and the short plate 43Cs by being inserted into screw holes which are formed in the waveguide flange 43CF to correspond to those holes.

In the ground plane 41, the annular member 43CR, the slot plate 44, and the annular member 43Cr, holes (not shown) into which the screws 43S-1 to 43S-5 are inserted and which have inside walls having a size and a shape with which they stably come in contact with sidewalls of these screws 43 S-1 to 43 S-5 are formed in advance.

In the triplate feed type planar antenna having such a configuration, the waveguide 43$C_{wc}$ (FIG. 7) is sandwiched by the screws 43S-1 to 43S-5 between the aforementioned waveguide flange 43CF and the short plate 43Cs, and formed by inside walls of the ground plane 41, the annular member 43CR, the slot plate 44, and the annular member 43Cr electrically connected by these screws 43S-1 to 43S-5.

In FIG. 7, the probe 43CP converts transmission waves which are output by a transmitter not shown in the drawings and transferred as an electromagnetic field of the fundamental mode propagating in the waveguide 43$C_{WC}$ into an "electromagnetic field of a triplate line."

On the flexible substrate 43, this "electromagnetic field of a triplate line" is guided to a point which is deviated from the center of the bus bar 43FM by a distance corresponding to a quarter of a wavelength, and is fed to half of the patch antennas 43$A_{1,1}$ to 43$A_{m,n}$ and the other half thereof with a phase difference of 180 degrees through the bus bar 43FM.

Also, in such a triplate feed type planar antenna, the phase of the cross-polarization component of one half of the patch antennas 43$A_{1,1}$ to 43$A_{m,n}$ is opposite to the phase of the cross-polarization component of the other half, and thus the cross-polarization components cancel each other, and thus cross-polarization discrimination is improved.

As prior art relevant to the present invention, there are Patent Literature 1 to Patent Literature 3 listed below.

Japanese Unexamined Patent Application, First Publication No. Hei 09-312515 discloses a polarized wave shared planar antenna "obtained by sequentially stacking a ground conductor, a dielectric, a feed substrate having a plurality of radiation elements and a feed line formed therein, a dielectric, a ground conductor having a plurality of slots installed so that the respective slots are disposed right above the radiation elements, a dielectric, a feed substrate having a plurality of radiation elements and a feed line formed therein, a dielectric, and a ground conductor having a plurality of slots installed so that the respective slots are disposed right above the radiation elements, and configured by electromagnetically coupling the radiation elements and the radiation elements together so that the excitation direction of the radiation elements in accordance with the feed line and the excitation direction of the radiation elements in accordance with the feed line cross at right angles, in which radiation elements corresponding to about half the number of array elements of the feed substrate and the feed substrate and a feed line or elements corresponding to about half the number of array elements of any one feed substrate and a feed line are spatially rotated 180 degrees with respect to a reference excitation direction and disposed, and which electrically changes a feeding phase by 180 degrees to be excited," thus having a characteristic such that "load on a signal-processing circuit is reduced in a planar antenna side as much as possible, and thus a cross-polarization characteristic and a wide band characteristic of isolation are obtained."

Japanese Unexamined Patent Application, First Publication No. Hei 11-312909 discloses a waveguide/microstrip line converter "in which a substrate providing a microstrip line so that an antenna probe is disposed toward an opening of a waveguide is sandwiched between a cap corresponding to the opening of the waveguide and a base member, and the microstrip line is connected to both ends of the antenna probe installed on the substrate" thus having a characteristic such that "it also has a function of distributing a feed from the antenna probe in order to reduce removal of antenna elements on the substrate as much as possible."

Japanese Patent No. 2595339 discloses a planar antenna "that has a triplate configuration in which strip lines formed on a substrate are inserted into a ground substrate with gaps left on both sides, has radiation elements formed on one side of the ground substrate, and supplies power to the respective radiation elements in parallel by a feed line of the strip lines, in which strip line-waveguide converters having strip lines of a final feed point inserted from both side surfaces of a waveguide and having a phase difference of 180 degrees between powers input from both strip lines to the waveguide are formed in spaces between radiation elements horizontally and vertically formed at regular spatial intervals," thus having a characteristic such that "it enables a feed by a waveguide capable of achieving favorable power combining (branching)."

SUMMARY OF THE INVENTION

Technical Problem

In the conventional example described above (FIG. 7), the main line 43B is connected to the point deviated from the center of the bus bar 43FM by a quarter of a wavelength (i.e., λ/4), so that the aforementioned phase difference of 180 degrees is ensured.

Therefore, when a frequency of a wireless signal to be transmitted or received has a wide-ranging value or a band occupied by the wireless signal is wide (for example, 2 GHz in a 12 GHz band), it is difficult to set the phase difference with sufficient precision.

Moreover, an error of such a phase difference in accordance with a frequency is a primary factor that causes degradation of cross-polarization discrimination to shift the direction of a main lobe, and puts a limitation on application of the triplate feed type planar antenna.

The error of such a phase difference can be reduced by configuring the triplate feed type planar antenna, for example, as shown in FIG. 9, as follows.

(1) A probe 43CP' is disposed at a portion on the flexible substrate 43(FIG.8) corresponding to a central portion in the waveguide 43$C_{wc}$ instead of the probe 43CP.

(2) The probe 43CP' is installed in the central portion of the main line 43B.

(3) Such a main line 43B passes through slits (through-holes) formed in opposite sidewalls of the waveguide 43$C_w$, and is guided to the outside of the waveguide 43$C_{wc}$.

Also, the error of a phase difference can be reduced by configuring the triplate feed type planar antenna, for example, as shown in FIG. 10, as follows.

(1) The probe 43CP' (FIG. 9) is not provided.

(2) The main line 43B is divided into two parts at its central portion, and tips are formed opposite to each other by a predetermined distance around the central portion in the waveguide 43$C_{wc}$ and facing the gap.

However, in these configurations shown in FIG. 9 and FIG. 10, impedance matching is not easily achieved in practice, and it is not possible to ensure a sufficient return loss bandwidth.

(1) Since there is air around the probe 43CP', it is difficult to effectively reduce a wavelength based on a relative permittivity.

(2) In general, a distance b between inside walls of the waveguide 43$C_{WC}$ opposite to each other is much smaller than a resonant length (=λ/2).

Therefore, in practice, the configurations shown in FIG. 9 and FIG. 10 are obstructed by limitations, such as a frequency, and physical sizes, shapes, dispositions, and the like of components other than the waveguide 43$C_{WC}$, and are not applied frequently In FIGS. 9 and 10, elements having the same function as those illustrated in FIG. 7 are given like numerals, and descriptions thereof will be omitted.

An object of the present invention is to provide a two-port triplate-line/waveguide converter in which coupling of triplate lines is realized over a wide band in opposite phases, at low cost without drastically complicating the configuration.

Solution to the Problem

In accordance with a first aspect of the present invention, a two-port triplate-line/waveguide converter includes a rectangular waveguide, and two probes which connect to central conductors of separate triplate lines through slits separately formed in two opposite inside walls of the rectangular waveguide and having openings on an imaginary straight line crossing the two inside walls at right angles. Tips of the two probes are bent inside the rectangular waveguide, and the two probes constitute monopole antennas with the inside walls functioning as ground planes.

In other words, the two probes are bent in the rectangular waveguide, so that unnecessary coupling between the two probes is reduced or suppressed. Moreover, the two probes function as the monopole antennas, so that two ports of opposite phases coupled to an electromagnetic field in the waveguide over a wide band are formed between the two probes and the separate triplate lines.

In accordance with a second aspect of the present invention, a two-port triplate-line/waveguide converter includes a rectangular waveguide, and two probes which connect to central conductors of separate triplate lines through slits separately formed in two opposite inside walls of the rectangular waveguide and having openings, the openings overlapping each other when seen from a direction perpendicular to the two inside walls. Each of the two probes has plural tips that are provided inside the rectangular waveguide and extend in different directions from each other, and the two probes constitute monopole antennas with the inside walls functioning as ground planes.

In other words, the two probes branch in a plurality of directions in the rectangular waveguide, so that unnecessary coupling between the two probes is reduced or suppressed. Moreover, the two probes function as the monopole antennas, so that two ports of opposite phases coupled to an electromagnetic field in the waveguide over a wide band are formed between the two probes and the separate triplate lines.

In accordance with a third aspect of the present invention, a two-port triplate-line/waveguide converter includes two probes which connect to central conductors of separate triplate lines through slits separately formed in two opposite inside walls of the rectangular waveguide and having openings, the openings overlapping each other when seen from a direction perpendicular to the two inside walls. Tips of the two probes are bent in directions not opposite to each other inside the rectangular waveguide, and the two probes constitute monopole antennas with the inside walls functioning as ground planes.

In other words, the tips of the two probes are bent in directions not opposite to each other in the rectangular waveguide, so that unnecessary coupling between the two probes is reduced or suppressed. Moreover, the two probes function as the monopole antennas, so that two ports of opposite phases coupled to an electromagnetic field in the waveguide over a wide band are formed between the two probes and the separate triplate lines.

Advantageous Effects of the Invention

According to the present invention, transfer of signals having phases opposite to each other is realized in parallel between a rectangular waveguide and two triplate lines without involving a drastic change of the configuration and a heavy dependence on a frequency compared to the conventional example.

An apparatus or a system to which the present invention is applied does not place serious obstructions or limitations on cost, installation, temperature, power consumption, or the like, and prevents the occurrence of technical problems resulting from a lack of precision in the opposite phases or a change of performance with high precision.

DETAILED DESCRIPTION OF THE EMBODIMENTS

Hereinafter, an embodiment of the present invention will be described in detail based on the drawings.

Figure 1:
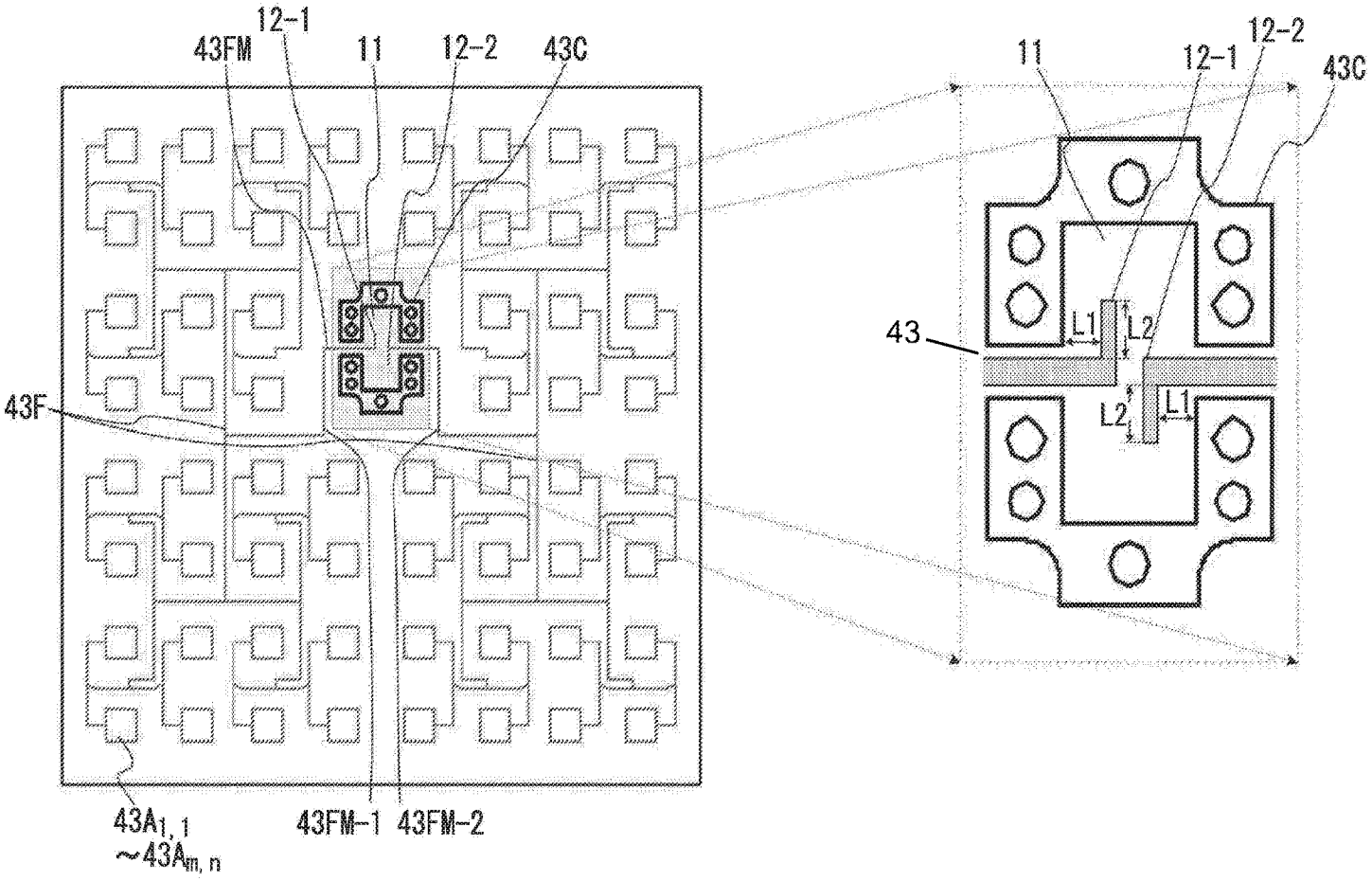
FIG. 1 is a diagram showing an embodiment of the present invention.
Figure 6:
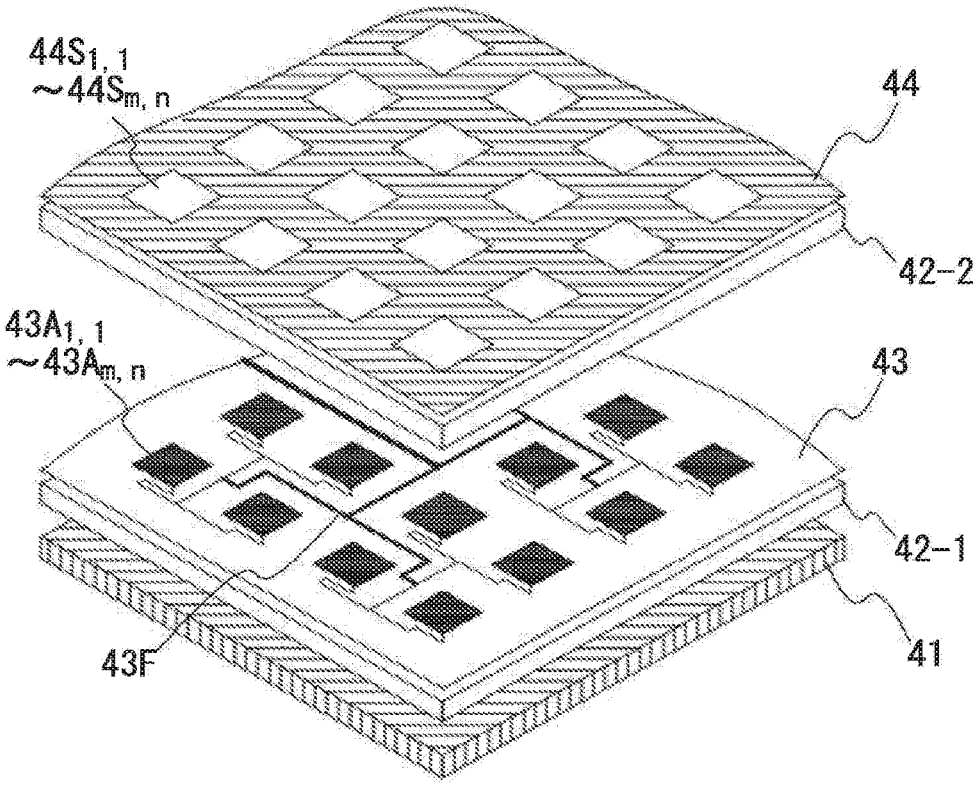
FIG. 6 (Conventional Art)
FIG. 6 is a diagram showing an example of a configuration of a conventional triplate feed type planar antenna.
Figure 7:
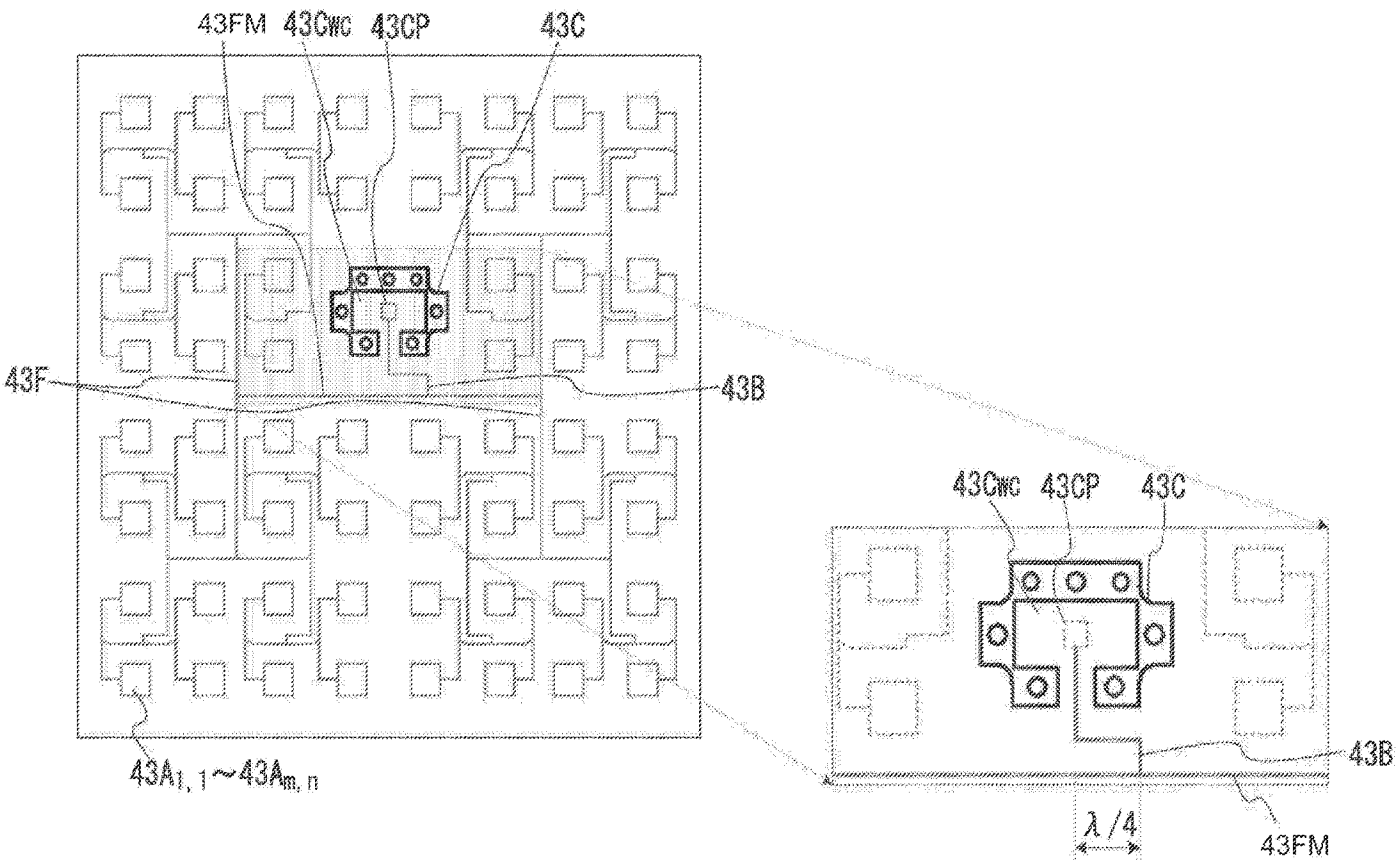
FIG. 7 (Conventional Art)
FIG. 7 is a diagram showing a configuration of a feed system of a conventional triplate feed type planar antenna.
Figure 8:
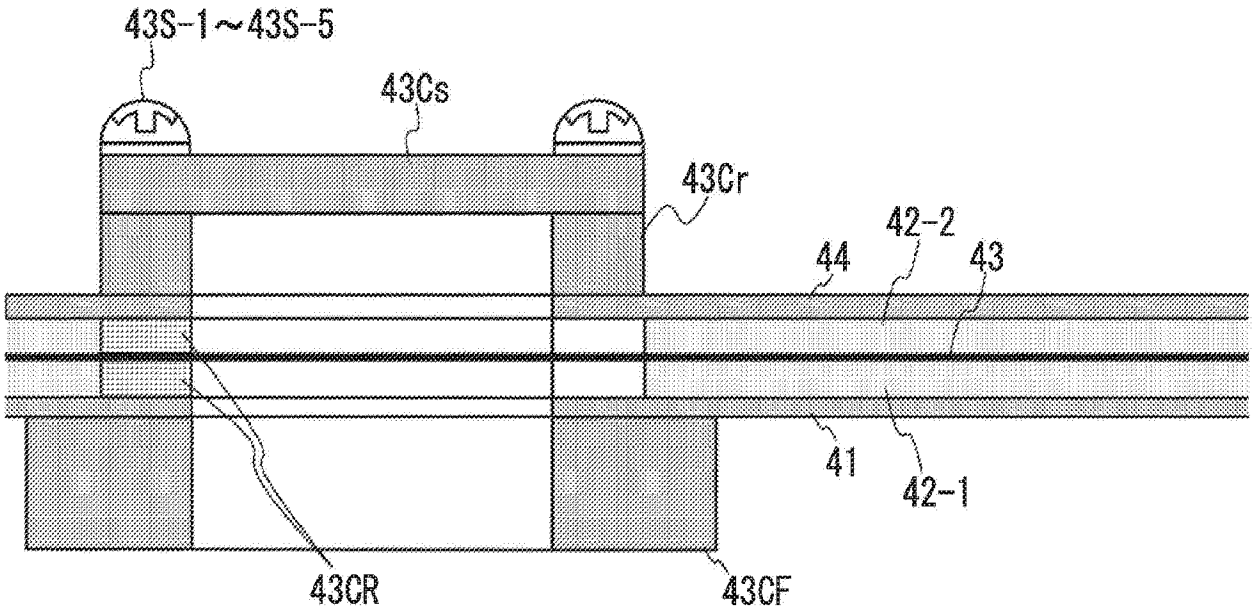
FIG. 8 (Conventional Art)
FIG. 8 is a diagram showing a configuration of a feed system of a conventional triplate feed type planar antenna.
Figure 9:
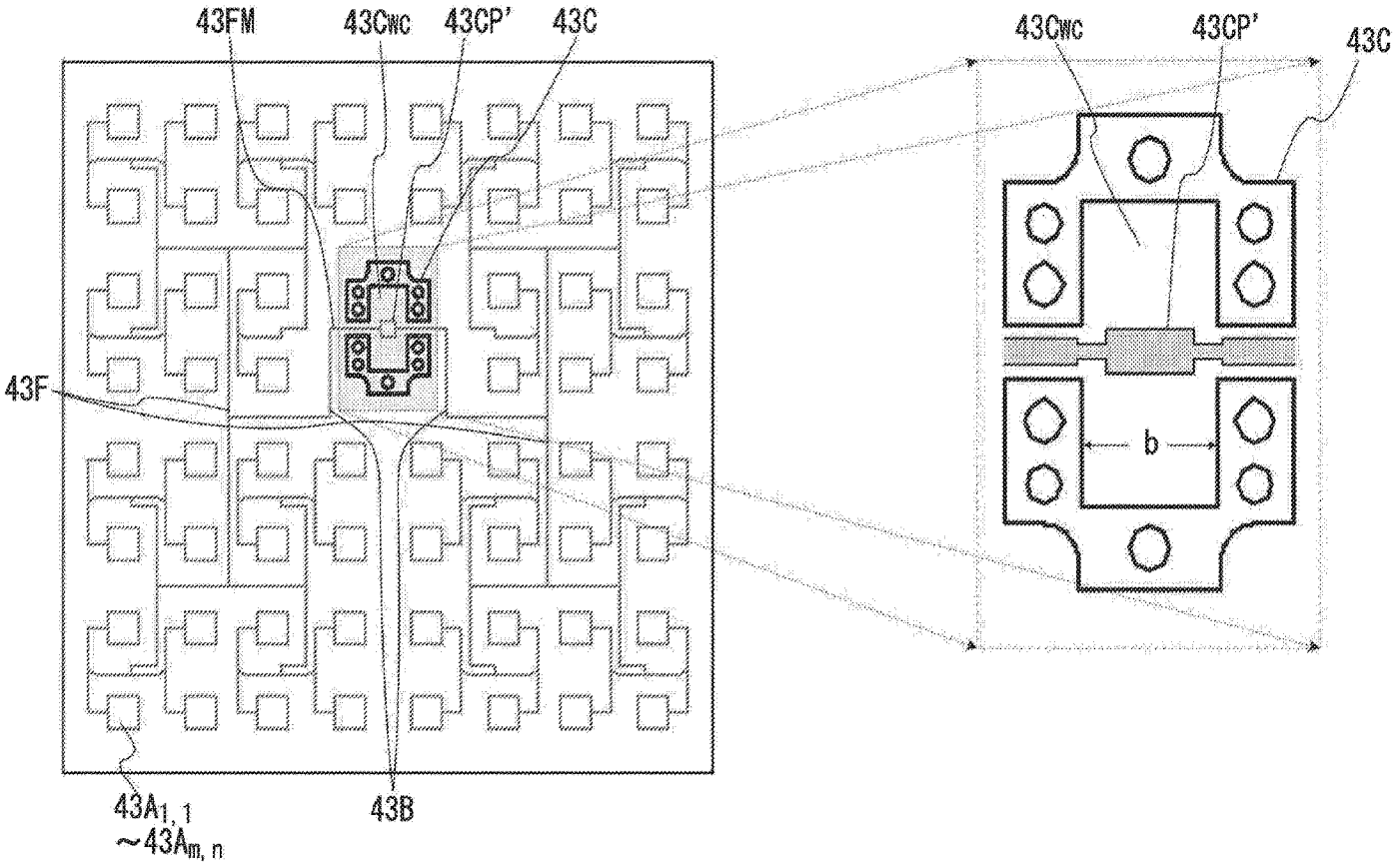
FIG. 9 (Conventional Art)
FIG. 9 is a diagram showing a solution to a conventional example.
Figure 10:
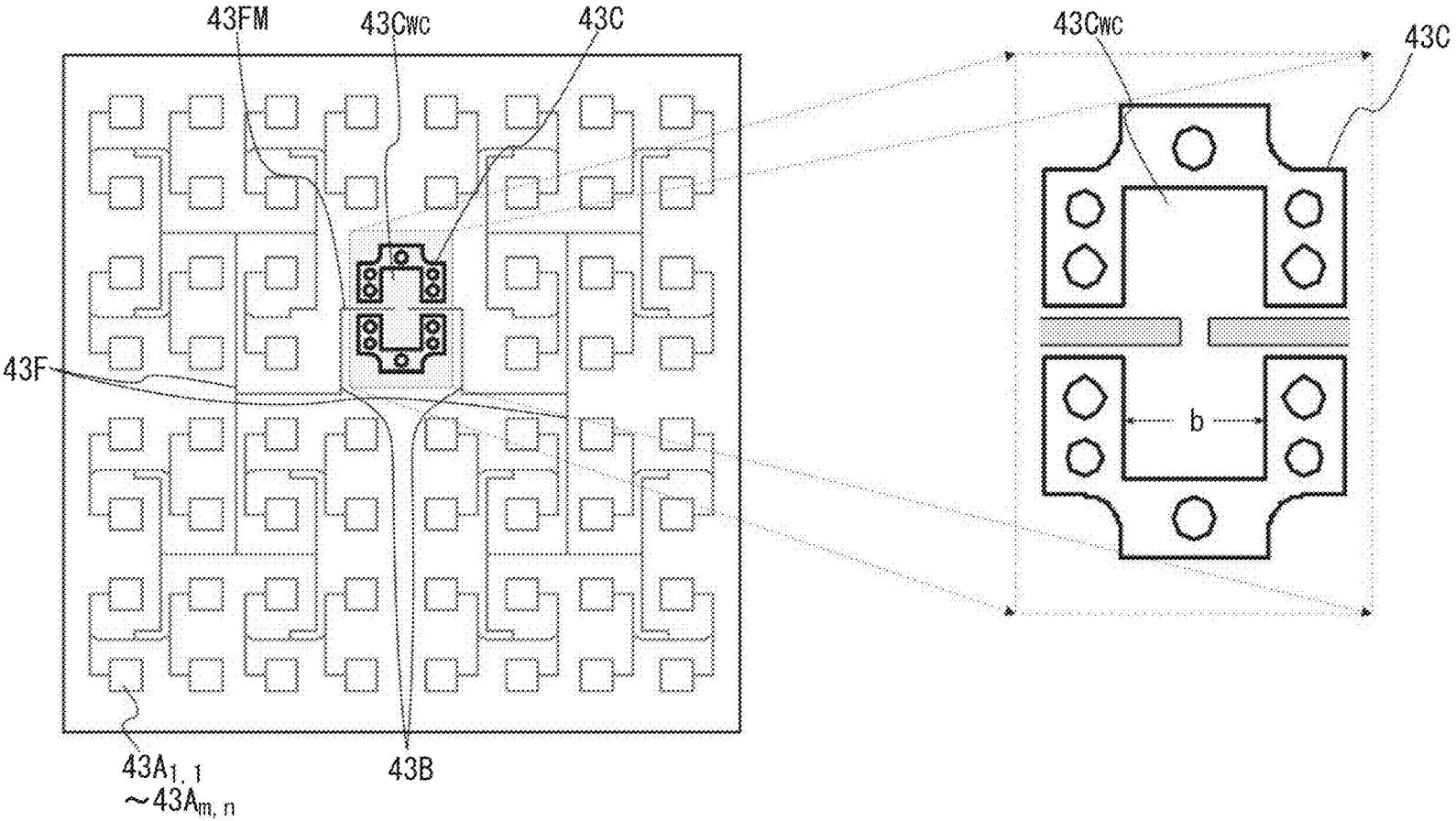
FIG. 10 is a diagram showing a solution to a conventional example.

In FIG. 1, the same elements as those shown in FIG. 6 to FIG. 8 are given like numerals, and descriptions thereof will be omitted here.

In FIG. 1, the same elements as those shown in FIG. 6 to FIG. 8 are given like signs, and descriptions thereof will be omitted here.

The present embodiment and the conventional example shown in FIG. 7 have the following differences in configuration (1) The main line 43B as in FIG. 7 is not provided.

(2) Instead of the waveguide 43$C_{wc}$ as in FIG. 7, a waveguide 11 is provided, and separate through-holes are formed at positions corresponding to one side surface of the flexible substrate 43 in two opposite sidewalls of the waveguide 11.

(3) The bus bar 43FM is divided into two parts at a central portion in the longitudinal direction, and tips of the parts are guided into the waveguide 11 through the respective through-holes. The two parts divided from the bus bar 43FM in this way are denoted by "43FM-1" and "43FM-2" as described below.

(4) Two probes 12-1 and 12-2 configured as will be described below are provided instead of the probe 43CP as in FIG. 7.

(4-1) The two probes 12-1 and 12-2 are formed on the flexible substrate 43 as circuit patterns, and as shown in FIG. 1, connect to the bus bars 43FM-1 and 43FM-2, respectively.

(4-2) The tips are bent in L shapes in directions so that areas of the tips opposite to each other in the waveguide 11 are minimized.

(4-3) The disposition of each of these tips in an inside wall of the waveguide 11 and the size are set as follows.

(4-3-1) In relation to a length Ll from an inside wall of the waveguide 11 to a bent portion and a length L2 from the bent portion to a tip, a length L in the waveguide 11 is given by the following equation.

$$L=Ll+L2$$

(4-3-2) In relation to a wavelength λ of a center frequency f in a band of a signal to be transferred from the inside of the waveguide 11 to the bus bars 43FM-1 and 43FM-2, the length L is given by the following equation.

$$L=\lambda/4$$

(4-3-3) The length Ll is set based on a balance between the degree of coupling between an electromagnetic field in the waveguide 11 and the probe 12-1 (12-2) and isolation to be ensured between the probes 12-1 and 12-2.

In the present embodiment configured in this way, both of the probes 12-1 and 12-2 function as monopole antennas which use a sidewall of the waveguide 11 as a ground plane.

Here, both of the probes 12-1 and 12-2 are bent in L shapes, and thus are sufficiently isolated from each other. Also, since both the probes 12-1 and 12-2 resonate at $L=(1/4)\lambda$, the current distribution of each of the probes 12-1 and 12-2 becomes even, and thus a band is widened.

Moreover, phases of an electromagnetic field coupled to the probes 12-1 and 12-2 in the waveguide 11 become opposite to each other, that is, 180 degrees.

In other words, half of the patch antennas 43$A_{1,1}$ to 43$A_{m,n}$ and the other half thereof are fed in parallel with power in opposite phases by the two-port waveguide-triplate line converter which includes the waveguide 11 and the probes 12-1 and 12-2 as described above.

Therefore, in the triplate feed type planar antenna to which the present embodiment is applied, slight changes are made as will be described below, and each half of the provided patch antennas is stably fed in an opposite phase.

(1) A configuration of the waveguide 11

(2) A specific circuit pattern associated with coupling with the waveguide 11 among circuit patterns formed on the flexible substrate 43

Figure 2:
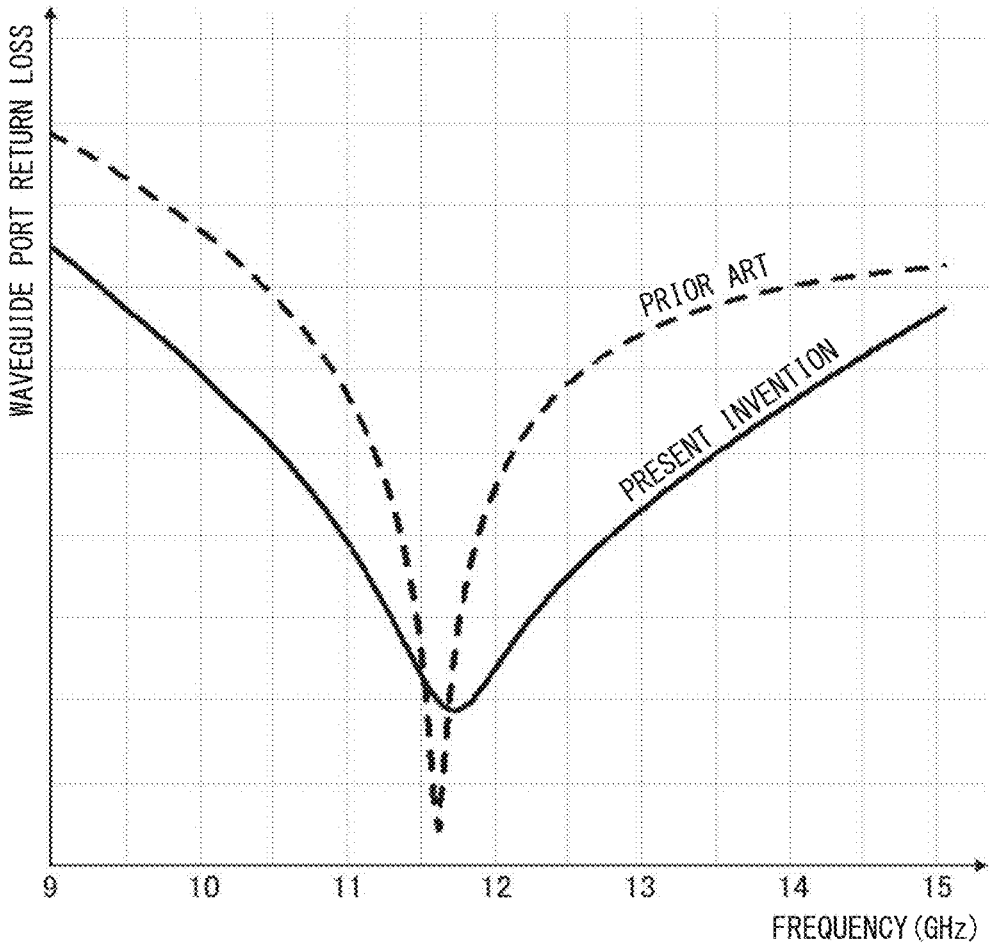
FIG. 2 is a diagram showing a return loss achieved by the present embodiment.
Figure 3:
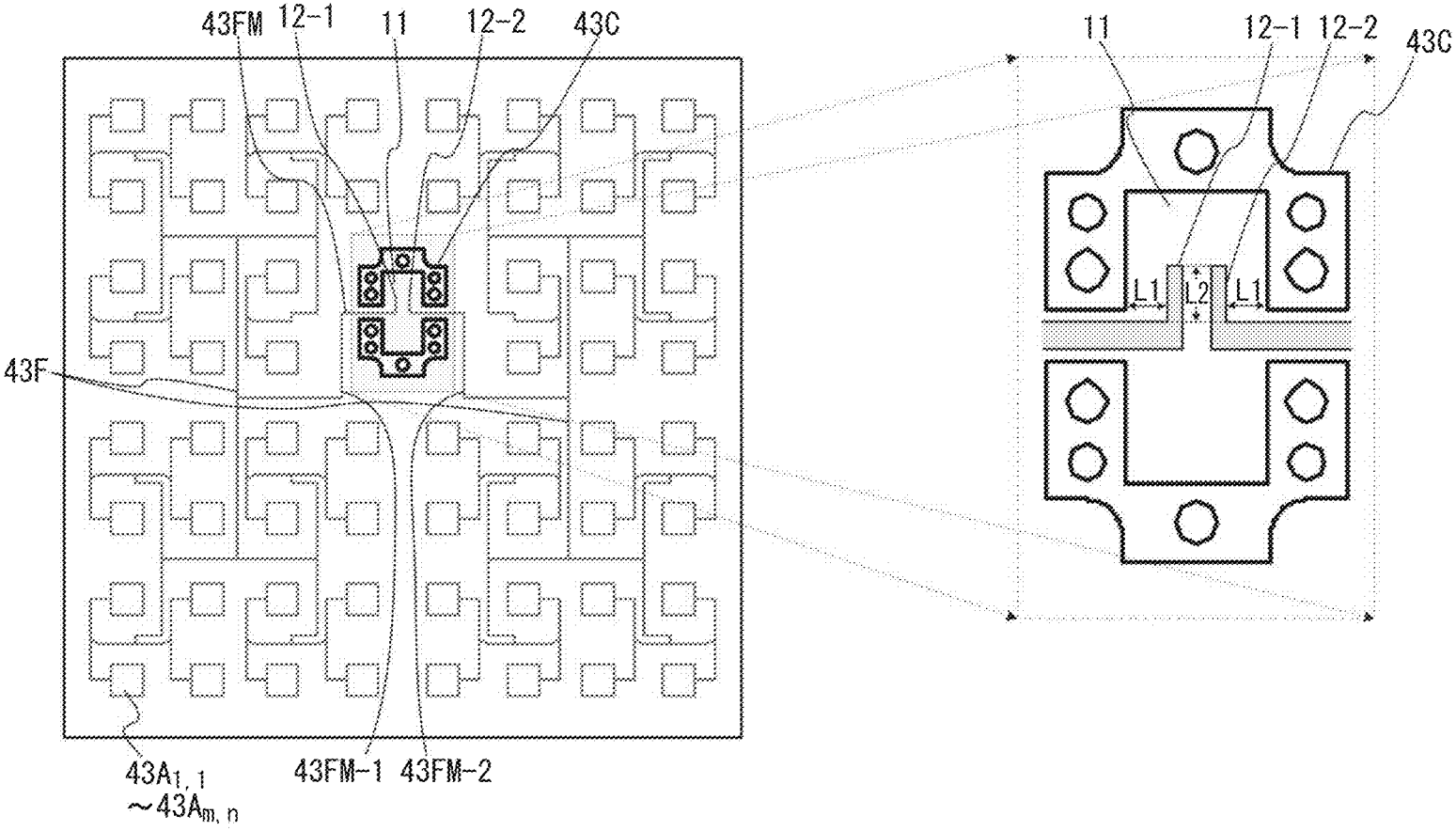
FIG. 3 is a diagram showing another aspect of a configuration of the present embodiment.
Figure 4:
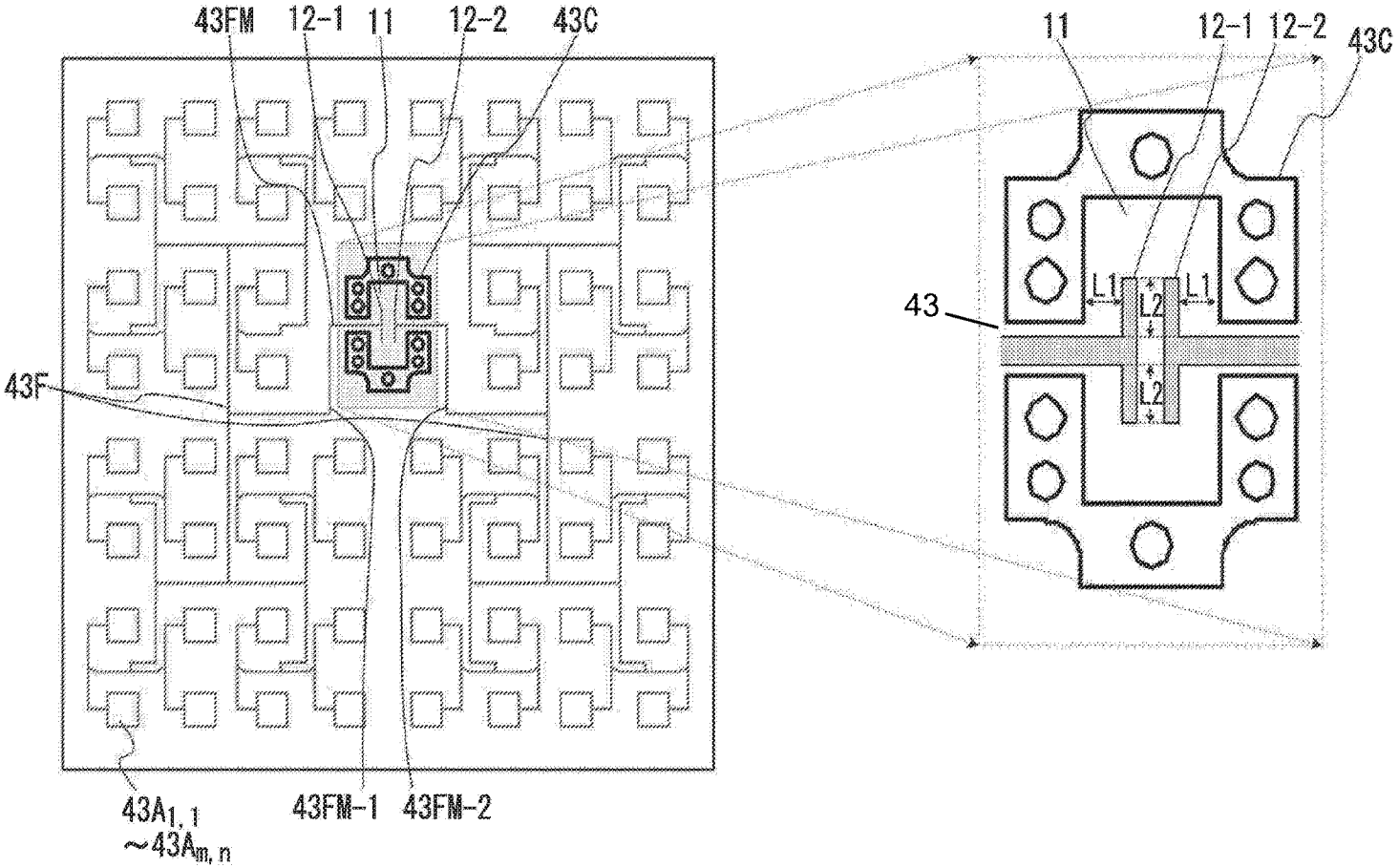
FIG. 4 is a diagram showing another aspect of a configuration of the present embodiment.

As shown in FIG. 2, such a feed is efficiently performed as measured by "waveguide port return loss" over a wide band as measured in frequency (in GHz) compared to the conventional example. FIG. 3 and FIG. 4 show other aspects of a configuration of the present embodiment. In FIG. 3 and FIG. 4, elements having the same function as those illustrated in FIG. 1 and in FIG. 5 (discussed later) are given like numerals, and descriptions thereof will be omitted here.

In the present embodiment, a feed by opposite phases is stably realized over a wide band as described above, and thus a shift of a main lobe which is about 0.3 degrees in the conventional example is suppressed to be within 0.1 degrees.

In the present embodiment, when isolation between the probes 12-1 and 12-2 and overall feed efficiency are achieved in a desired range, the probes 12-1 and 12-2 are not limited to the aspect shown in FIG. 1 and may be configured in any of the forms listed below.

(1) As shown in FIG. 3, the tips are disposed to be opposite to each other within a range allowed by a reduction in isolation between the probes 12-1 and 12-2.

(2) As shown in FIG. 4, the tips branch in T shapes (i.e. not L shapes) so that the probes 12-1 and 12-2 function as T-shaped monopole antennas.

(3) A direction in which the tips branch is not limited to the pattern surface of the flexible substrate 43 and is set to cross the pattern surface of the flexible substrate 43 within the limitation of cost or the range of technical feasibility.

(4) The probes 12-1 and 12-2 are formed on a different surface of the flexible substrate 43 than the bus bars 43FM-1 and 43FM-2 in a form in which they are connected to the bus bars 43FM-1 and 43FM-2, which are central conductors of the triplate lines, outside the waveguide 11.

(5) The probes 12-1 and 12-2 are different in both or either one of shape and size.

In the present embodiment, through-holes into which the probes 12-1 and 12-2 are inserted are formed in a linear shape in two sidewalls of the waveguide 11 opposite to each other.

However, such a shape of the through-holes may be a shape which is bent in a desired shape and size as long as there is no problem in overall characteristics.

These through-holes may not necessarily have the same shape or size.

In the present embodiment, the number of patch antennas to be fed in phases opposite to each other may be any value.

In addition, the present invention can be applied not only to a triplate feed type planar antenna but also to any apparatus or system in which coupling between a waveguide and two triplate lines should be stably realized over a wide band with high precision in opposite phases.

Figure 5:
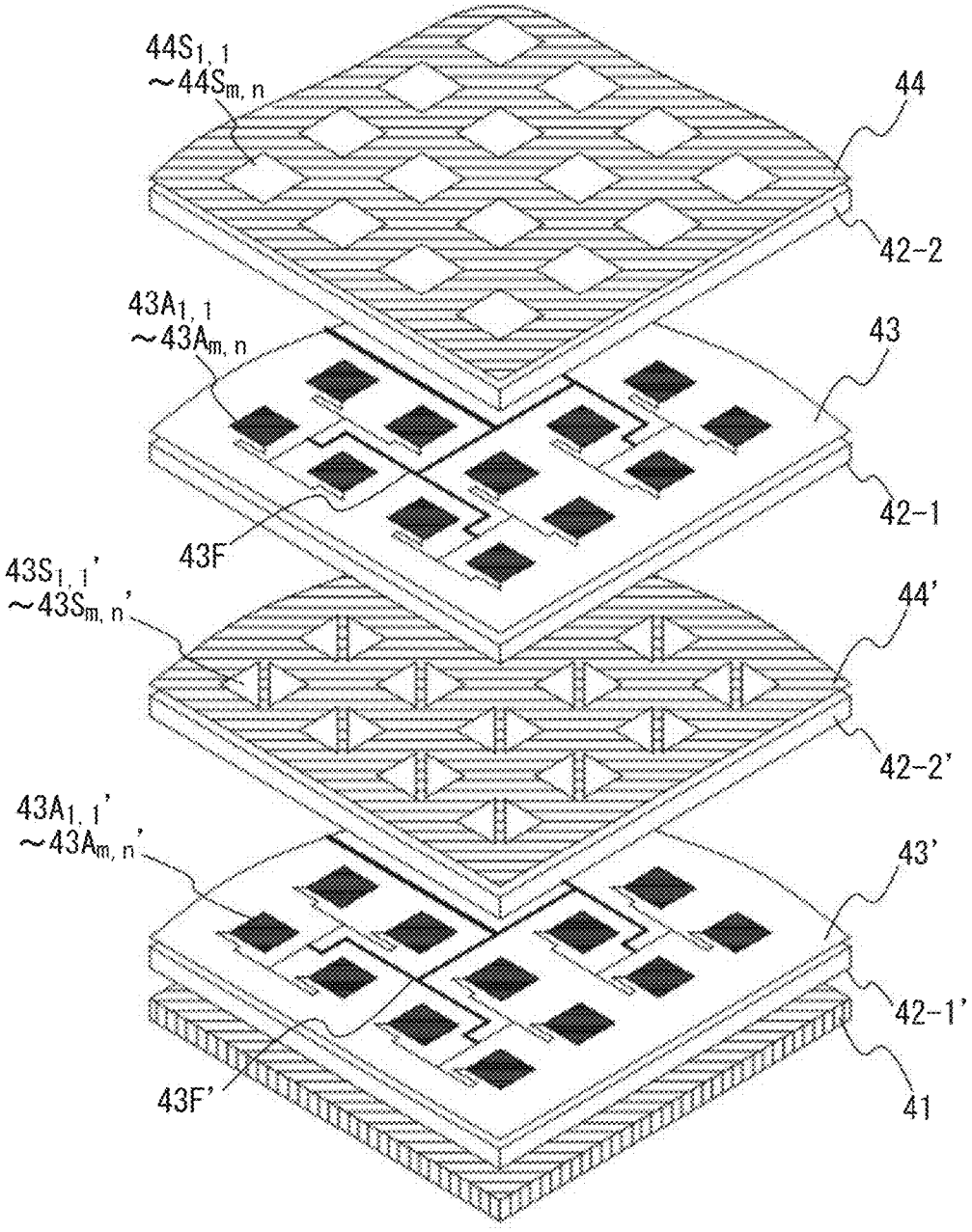
FIG. 5 is a diagram showing a configuration of a polarized wave shared triplate feed type planar antenna to which the present invention can be applied.

Also, the present invention can be applied not only to a polarized wave-dedicated planar antenna that forms a wireless transmission path with polarized waves common in an uplink and a downlink, but also to, for example, a polarized wave shared planar antenna that forms these links with polarized waves orthogonal to each other as shown in FIG. 5. FIG. 5 shows a polarized wave shared type planar antenna that has triplate lines on both of the upper layer and the lower layer. The triplate lines on the upper layer and the triplate lines on the lower layer can be fed with power respectively by using the two-port converter of the present invention. The elements in FIG. 5 that have the same function as those illustrated in FIG. 6 to FIG. 8 are given like numerals, and descriptions thereof will be omitted here. Remaining elements in FIG. 5 are defined as follows:

(1) 44 represents a slot plate of the upper layer.

(2) 42-1 and 42-2 represent foam sheets of the upper layer.

(3) 43 represents a flexible substrate of the upper layer.

(4) 44' represents a slot plate of the lower layer.

(5) 42-1' and 42-2' represent foam sheets of the lower layer.

(6) 43' represents a flexible substrate of the lower layer.

(7) 41 represents a ground plane.

(8) 43$A_{l,l}$ to 43$A_{m,n}$ represent patch antennas of the upper layer.

(9) 43$A_{l,l}'$ to 43$A_{m,n}'$ represent patch antennas of the lower layer.

(10) 44$S_{l,l}$ to 44$S_{m,n}$ represent slot openings of the upper layer.

(11) 44$S_{l,l}'$ to 44$S_{m,n}'$ represent slot openings of the lower layer.

(12) 43F represents a feed line of the upper layer.

(13) 43F' represents a feed line of the lower layer.

The present invention is not limited to the embodiment described above. Various embodiments can be made within the scope of the present invention, and any modifications may be made to all or some of the components.

INDUSTRIAL APPLICABILITY

The present invention can be widely applied to two-port triplate-line/waveguide converters that have two ports coupled to an electromagnetic field in a rectangular waveguide, and transfer the electromagnetic field to triplate lines connecting to these ports.

According to the present invention, transfer of signals having phases opposite to each other is realized in parallel between a rectangular waveguide and two triplate lines without involving a drastic change of the configuration and a heavy dependence on a frequency compared to the conventional example.

An apparatus or a system to which the present invention is applied does not put serious obstructions or limitations on cost, installation, temperature, power consumption, or the like, and prevents the occurrence of technical problems resulting from a lack of precision in the opposite phases or a change of performance with high precision.

REFERENCE SIGNS LIST

11, 43$C_{WC}$ Waveguide
12, 43CP Probe
41 Ground plane
42 Foam sheet
43 Flexible substrate
43A Patch antenna
43B Main line
43C Waveguide-triplate line converter
43CF Waveguide flange
43CR Annular member
43Cr Annular member
43Cs Short plate
43F Feed line
43FM Bus bar
44 Slot plate
44S Slot opening

The invention claimed is:

1. A two-port triplate-line or waveguide converter, comprising:

a rectangular waveguide; and two probes which connect to central conductors of separate triplate lines extending through slits separately formed in two opposite inside walls of the rectangular waveguide and having openings, the openings aligned with each other when seen from a direction perpendicular to the two inside walls, wherein tips of the two probes are bent inside the rectangular waveguide, and the two probes constitute monopole antennas with the inside walls functioning as ground planes, and a length of each of the two probes inside the rectangular waveguide is $\lambda/4$, and where $\lambda$ is a wavelength of a center frequency in a band of a signal to be transferred to the central conductors.

2. A two-port triplate-line or waveguide converter, comprising:

a rectangular waveguide; and two probes which connect to central conductors of separate triplate lines extending through slits separately formed in two opposite inside walls of the rectangular waveguide and having openings, the openings aligned with each other when seen from a direction perpendicular to the two inside walls, wherein each of the two probes has plural tips that are provided inside the rectangular waveguide and extend in different directions from each other, and the two probes constitute monopole antennas with the inside walls functioning as ground planes, and a length of each of the two probes inside the rectangular waveguide is $\lambda/4$, and where $\lambda$ is a wavelength of a center frequency in a band of a signal to be transferred to the central conductors.

3. A two-port triplate-line or waveguide converter, comprising:

two probes which connect to central conductors of separate triplate lines extending through slits separately formed in two opposite inside walls of the rectangular waveguide and having openings, the openings aligned with each other when seen from a direction perpendicular to the two inside walls, wherein tips of the two probes are bent in directions not opposite to each other inside the rectangular waveguide, and the two probes constitute monopole antennas with the inside walls functioning as ground planes, and a length of each of the two probes inside the rectangular waveguide is $\lambda/4$, and where $\lambda$ is a wavelength of a center frequency in a band of a signal to be transferred to the central conductors.

* * * * *